US008062150B2

(12) United States Patent
Gilbert et al.

(10) Patent No.: US 8,062,150 B2
(45) Date of Patent: Nov. 22, 2011

(54) IRON-TYPE GOLF CLUB

(75) Inventors: Peter J. Gilbert, Carlsbad, CA (US); Charles E. Golden, Encinitas, CA (US); Michael Scott Burnett, Plano, TX (US)

(73) Assignee: Acushnet Company, Fairhaven, MA (US)

( * ) Notice: Subject to any disclaimer, the term of this patent is extended or adjusted under 35 U.S.C. 154(b) by 266 days.

(21) Appl. No.: 11/854,689

(22) Filed: Sep. 13, 2007

(65) Prior Publication Data

US 2009/0075750 A1 Mar. 19, 2009

(51) Int. Cl.
*A63B 53/04* (2006.01)

(52) U.S. Cl. ..... 473/332; 473/342; 473/345; 473/346; 473/349; 473/350

(58) Field of Classification Search ..... 473/324–350
See application file for complete search history.

(56) References Cited

U.S. PATENT DOCUMENTS

| | | | | | |
|---|---|---|---|---|---|
| 4,645,207 | A | * | 2/1987 | Teramoto et al. | 473/290 |
| 4,754,969 | A | | 7/1988 | Kobayashi | |
| 4,787,636 | A | * | 11/1988 | Honma | 473/349 |
| 4,824,110 | A | * | 4/1989 | Kobayashi | 473/332 |
| 4,852,880 | A | * | 8/1989 | Kobayashi | 473/349 |
| 5,048,835 | A | | 9/1991 | Gorman | |
| 5,062,638 | A | * | 11/1991 | Shira | 473/350 |
| 5,120,062 | A | * | 6/1992 | Scheie et al. | 473/314 |
| 5,184,823 | A | * | 2/1993 | Desboilles et al. | 473/345 |
| 5,193,805 | A | * | 3/1993 | Solheim | 473/291 |
| 5,282,625 | A | | 2/1994 | Schmidt et al. | |
| 5,328,175 | A | * | 7/1994 | Yamada | 473/346 |
| 5,409,229 | A | | 4/1995 | Schmidt et al. | |
| 5,439,223 | A | * | 8/1995 | Kobayashi | 473/334 |
| 5,447,311 | A | * | 9/1995 | Viollaz et al. | 473/342 |
| 5,472,203 | A | | 12/1995 | Schmidt et al. | |
| 5,492,327 | A | | 2/1996 | Biafore, Jr. | |
| 5,499,819 | A | * | 3/1996 | Nagamoto | 473/346 |
| 5,522,593 | A | * | 6/1996 | Kobayashi et al. | 473/349 |
| 5,547,194 | A | * | 8/1996 | Aizawa et al. | 473/350 |
| 5,562,551 | A | * | 10/1996 | Rife | 473/291 |
| 5,564,705 | A | * | 10/1996 | Kobayashi et al. | 473/334 |
| 5,586,947 | A | * | 12/1996 | Hutin | 473/324 |
| 5,605,511 | A | | 2/1997 | Schmidt et al. | |
| 5,674,133 | A | * | 10/1997 | Chang et al. | 473/291 |
| 5,683,310 | A | * | 11/1997 | Chen | 473/349 |
| D389,540 | S | | 1/1998 | Mendenhall | |
| 5,704,849 | A | | 1/1998 | Schmidt et al. | |
| 5,722,900 | A | * | 3/1998 | Sung | 473/291 |
| 5,749,794 | A | * | 5/1998 | Kobayashi et al. | 473/342 |
| 5,749,795 | A | | 5/1998 | Schmidt et al. | |
| 5,766,092 | A | * | 6/1998 | Mimeur et al. | 473/329 |
| 5,792,005 | A | * | 8/1998 | Sieleman et al. | 473/349 |
| 5,830,084 | A | | 11/1998 | Kosmatka | |
| 5,833,551 | A | * | 11/1998 | Vincent et al. | 473/350 |
| D404,453 | S | | 1/1999 | Wozny et al. | |
| D404,780 | S | | 1/1999 | Long | |
| 5,913,735 | A | * | 6/1999 | Kenmi | 473/338 |
| 5,971,866 | A | * | 10/1999 | Adams et al. | 473/328 |

(Continued)

FOREIGN PATENT DOCUMENTS

FR 2703913 A1 * 10/1994

(Continued)

*Primary Examiner* — Alvin Hunter
(74) *Attorney, Agent, or Firm* — Michael J. Mancuso

(57) ABSTRACT

Disclosed herein is a golf club including a club head having a muscle back shell or a lightweight muscle back.

15 Claims, 6 Drawing Sheets

U.S. PATENT DOCUMENTS 5,971,868 A 10/1999 Kosmatka
6,012,990 A * 1/2000 Nishizawa ..... 473/345
6,027,415 A * 2/2000 Takeda ..... 473/291
6,030,293 A * 2/2000 Takeda ..... 473/334
6,030,295 A * 2/2000 Takeda ..... 473/345
6,042,486 A 3/2000 Gallagher
6,080,069 A 6/2000 Long
D429,511 S 8/2000 Adams et al.
6,099,414 A * 8/2000 Kusano et al. ..... 473/342
6,106,412 A * 8/2000 Kosugi et al. ..... 473/305
D438,584 S 3/2001 Adams et al.
D438,925 S 3/2001 Adams et al.
D438,926 S 3/2001 Adams et al.
6,210,290 B1 4/2001 Erickson et al.
6,290,607 B1 * 9/2001 Gilbert et al. ..... 473/291
D453,949 S 2/2002 Helmstetter et al.
6,368,231 B1 * 4/2002 Chen ..... 473/329
6,379,262 B1 * 4/2002 Boone ..... 473/324
6,379,263 B2 4/2002 Erickson et al.
6,440,009 B1 * 8/2002 Guibaud et al. ..... 473/334
6,482,104 B1 * 11/2002 Gilbert ..... 473/287
6,491,593 B2 * 12/2002 Takeda ..... 473/342
6,551,200 B1 * 4/2003 Golden et al. ..... 473/349
6,554,722 B2 * 4/2003 Erickson et al. ..... 473/334
D476,708 S 7/2003 Wahl et al.
6,592,469 B2 * 7/2003 Gilbert ..... 473/350
6,595,870 B2 7/2003 Stites et al.
6,666,779 B1 * 12/2003 Iwata et al. ..... 473/350
6,709,345 B2 * 3/2004 Iwata et al. ..... 473/291
D489,106 S 4/2004 Wahl et al.
6,743,120 B1 * 6/2004 Chen ..... 473/349
6,793,591 B2 * 9/2004 Takeda ..... 473/342
6,814,674 B2 * 11/2004 Clausen et al. ..... 473/342
D500,350 S 12/2004 Schweigert et al.
D500,351 S 12/2004 Schweigert et al.
6,832,962 B2 12/2004 Stites et al.
D501,035 S 1/2005 Wahl et al.
6,843,733 B1 * 1/2005 Llewellyn et al. ..... 473/349
6,855,069 B2 * 2/2005 Nagai et al. ..... 473/335
D505,466 S 5/2005 Lang et al.
6,902,495 B2 * 6/2005 Pergande et al. ..... 473/332
6,916,253 B2 * 7/2005 Takeda ..... 473/349
6,923,732 B2 8/2005 Stites et al.
6,929,563 B2 * 8/2005 Nishitani ..... 473/334
6,932,717 B2 8/2005 Hou et al.
D510,115 S 9/2005 Lang et al.
6,971,961 B2 * 12/2005 Chen ..... 473/342
6,984,180 B2 * 1/2006 Hasebe ..... 473/291
6,991,559 B2 * 1/2006 Yabu ..... 473/332
D517,625 S 3/2006 Sanchez et al.
7,018,305 B2 * 3/2006 Sugimoto ..... 473/342
D518,539 S 4/2006 Cleveland et al.
7,022,027 B2 * 4/2006 Chen ..... 473/291
7,112,148 B2 9/2006 Deshmukh
D530,760 S 10/2006 Schweigert et al.
7,126,339 B2 10/2006 Nagai et al.
D532,848 S 11/2006 Cleveland et al.
7,137,903 B2 * 11/2006 Best et al. ..... 473/290
7,153,222 B2 * 12/2006 Gilbert et al. ..... 473/349
7,169,057 B2 * 1/2007 Wood et al. ..... 473/290
7,182,698 B2 * 2/2007 Tseng ..... 473/332
7,186,187 B2 * 3/2007 Gilbert et al. ..... 473/290
7,186,188 B2 3/2007 Gilbert et al.
7,192,361 B2 3/2007 Gilbert et al.
7,192,362 B2 3/2007 Gilbert et al.
7,303,486 B2 * 12/2007 Imamoto ..... 473/332
7,396,290 B2 * 7/2008 Gilbert et al. ..... 473/290
7,410,424 B2 * 8/2008 Chen ..... 473/291
7,435,187 B2 * 10/2008 Stites et al. ..... 473/318
2004/0023730 A1 * 2/2004 Nagai et al. ..... 473/345
2005/0170908 A1 8/2005 Reyes et al.
2005/0239570 A1 * 10/2005 Best et al. ..... 473/292
2007/0249431 A1 * 10/2007 Lin ..... 473/324

FOREIGN PATENT DOCUMENTS

GB 2240932 A * 8/1991
GB 2249031 A * 4/1992
GB 2268412 A * 1/1994
JP 03182266 A * 8/1991
JP 04241882 A * 8/1992
JP 04241883 A * 8/1992
JP 04241884 A * 8/1992
JP 04332573 A * 11/1992
JP 04341281 A * 11/1992
JP 06039061 A * 2/1994
JP 06154368 A * 6/1994
JP 06296717 A * 10/1994
JP 06319836 A * 11/1994
JP 07255884 A * 10/1995
JP 08024380 A * 1/1996
JP 08299509 A * 11/1996
JP 10248973 A * 9/1998
JP 2000210399 A * 8/2000
JP 2001259094 A * 9/2001
JP 2001321472 A * 11/2001
JP 2002143355 A * 5/2002
JP 2003102881 A * 4/2003
JP 2003265653 A * 9/2003
JP 2005185751 A * 7/2005
JP 2006167317 A * 6/2006
JP 2006212066 A * 8/2006
JP 2006289105 A * 10/2006
JP 2007275231 A * 10/2007
JP 2007319687 A * 12/2007

* cited by examiner

IRON-TYPE GOLF CLUB

FIELD OF THE INVENTION

This invention generally relates to golf clubs, and more specifically to iron-type golf club having an enclosed lower hollow cavity behind the hitting face.

BACKGROUND OF THE INVENTION

Typical iron club heads are solid with a flat hitting face and generally either muscle back and cavity back clubs. Traditionally all irons were muscle back, which are smooth at the back with low offset, thin topline and thin sole. Cavity back irons have a hollowed out back and the club head mass is redistributed to the sole and the perimeter of the club head, which moves the center of gravity lower to the ground and rearward making the iron launch the ball higher, and increases rotational moment of inertia thereby lowering its tendency to rotate on mis-hits and enlarging the sweet spot.

Some muscle back irons have an interior hollow section, such that the club resembles a muscle back on the outside but the interior hollow section alters the club's mass characteristics. One example is U.S. Pat. No. 4,645,207 to Teramoto et al. The Teramoto patent discloses a set of iron golf clubs in which the iron club is cast by the lost wax method, and the back member is welded at the back of the face member to form a hollow section between the back and face members. As the club changes from a longer iron to a shorter iron, the hollow section is gradually decreased to zero and the sole width is gradually decreased. No support is provided to the hitting face.

Another example is U.S. Pat. No. 4,754,969 to Kobayashi. The Kobayashi patent discloses a set of golf clubs wherein each one-piece club head includes a hollow section behind the striking face. Each of the club heads is made of a stainless steel by, for example, a lost wax casting process. The material of each of the face portions of the club heads is then annealed to increase its elasticity. The striking face is thinner for long irons, but no support is provided to the hitting face.

Another example is U.S. Pat. No. 7,126,339 to Nagai et al., which discloses utility golf clubs, which generally include a hollow interior.

There remains a need in the art for an improved iron-type golf club.

SUMMARY OF THE INVENTION

The present invention is directed to iron-type golf club. The inventive iron-type golf club provides a club head that provides the aesthetics of a muscle back iron while improving club head center of gravity disposition, increasing moment of inertia and sweet spot size.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 2:
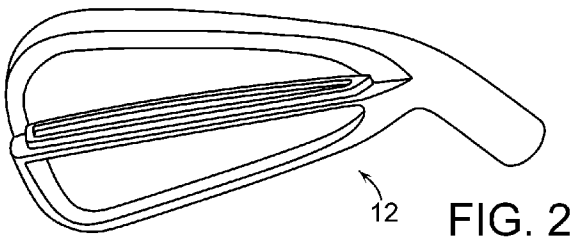
FIG. 2 is a perspective bottom view of club head main body of FIG. 1 without the muscle back shell.
Figure 3:
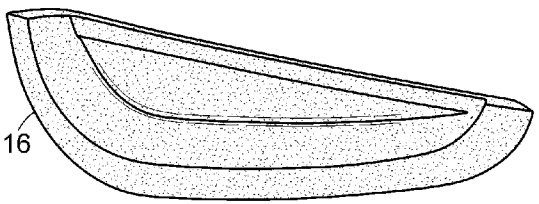
FIG. 3 is a perspective back view of muscle back shell of FIG. 1.

The present invention is directed to hollow iron-type golf clubs and can also be used with utility golf clubs. The inventive iron-type golf club provides the aesthetics of a muscle back iron while moving the center of gravity lower and further back, increasing moment of inertia, and enlarging sweet spot similar to a cavity back club. The inventive club can accomplish this goal by incorporating a hollow interior cavity in the muscle portion of the club, supporting a thin hitting face with a supporting member, and adding a high density rear sole portion. Additionally, weight from the upper toe can be redistributed to other portions of the club head to improve mass characteristics, and can be advantageously replaced by a vibration and sound dampener. The end result of the present invention is a club that resembles a muscle back iron that low handicap players use, but the club plays like the forgiving cavity back irons that high handicap players prefer. Several embodiments of the present invention are described below.

Referring to FIGS. 1, 2, 3 and 4, a hollow iron-type golf head 10 comprises club head main body 12 including support 14, and muscle back shell 16. Support 14 and partial sole 18 of club head main body 12 are sized and dimensioned to fit flush with muscle back shell 16.

Club head main body 12 is preferably made from a lower density material than muscle back shell 16 to move club head center of gravity lower and further back to increase moment of inertia and sweet spot size to improve the golfer's chances for effective ball-striking. Preferably, main body 12 has a density in the range of about 4 g/cm$^3$ to about 8 g/cm$^3$ and muscle back shell 16 has a density in the range of about 9 g/cm$^3$ to about 19 g/cm$^3$. Suitable materials for club head main body 12 include, but are not limited to, aluminum, stainless steel or titanium and alloys thereof. Preferably, club head main body 12 is made from titanium alloy. Suitable materials for muscle back shell 16 include, but are not limited to, lead, tungsten, gold, or silver. Preferably, muscle back shell 16 is made from tungsten or tungsten nickel alloy. These material alternatives are applicable to all of the embodiments described herein. Preferably, materials with higher density, such as stainless steel and tungsten are located below and away from the center of gravity or the geometric center to enhance mass properties, e.g., larger rotational moment of inertia and lower center of gravity.

Figure 4:
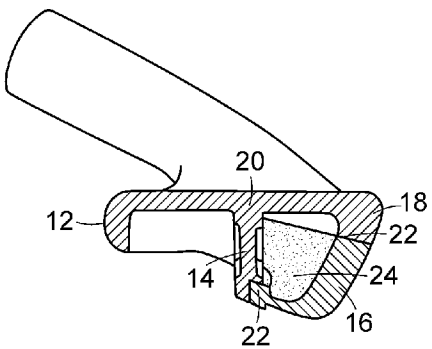
FIG. 4 is a cross-sectional view along line 4-4 of FIG. 1.

As discussed above, it is desirable to have a relatively thin hitting face so that extra mass can be redistributed. However, golf club and golf ball impacts can create a force of up to 2,000 lbs. Repeated impacts may adversely affect the structural integrity of hitting face 20. In accordance with an aspect of the present invention, support 14 is provided behind hitting face 20 to improve its mechanical integrity. While any number of supports can be deployed and the supports can be arranged in any orientation, it is preferred that a single support 14 is used and is positioned in the toe-to-heel direction. Furthermore, as best shown in FIG. 4 support 14 has an I-beam profile, which is known to have high structural integrity and resistance to bending forces while being relatively light weight. Alternatively, support 14 can have any profile including, but not limited to, square, triangular, rectangular, "X", "Y," circular, semi-circular, elliptical, etc.

Figure 1:
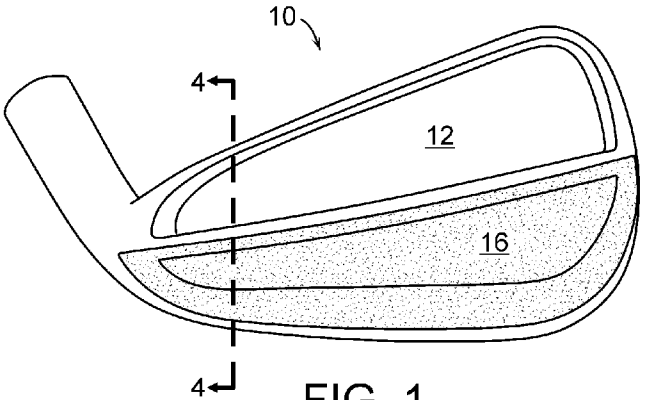
FIG. 1 is a rear view of a hollow iron-type golf club in accordance with the present invention.
Figure 1A:
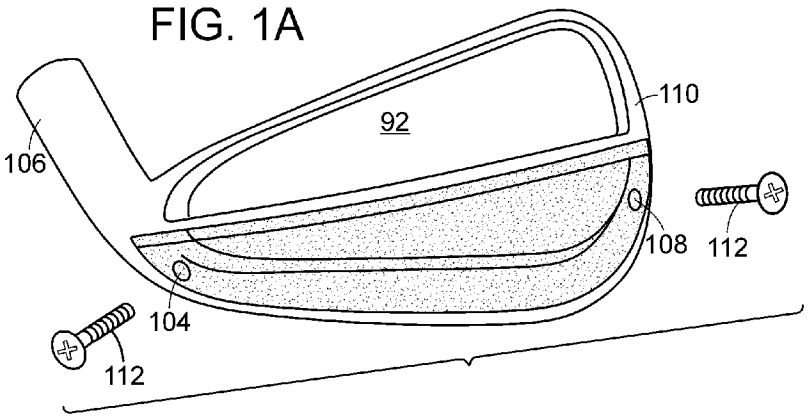
FIG. 1A is a perspective rear view of the club head main body without a muscle back shell.

To assemble club head 10, muscle back shell 16 is attached to support 14 and partial sole 18 of club head main body 12 at attachment lines 22. Preferably, attachments 22 of muscle back shell 16 to club head main body 12 are made permanent by welding or force fitting with or without adhesive. Alternatively, shell 16 can be attached via fasteners 112, such as screws and rivets, and holes 98 as shown in FIG. 1A. An advantage of disposing attachments 22 away from hitting face 20 is that the high force of the golf club and golf ball impacts are less likely to cause mechanical failure of attachments 22. This advantage is applicable to all of the embodiments described herein. Preferably, plasma welding is used to attach the heel to main body 12 and laser welding is used to attach support 14 to hitting face 20 of main body 12.

Referring to FIG. 1A, an alternative embodiment comprises a bore 104 with internal threads in the heel below hosel 106 of club head main body 92, a bore 108 with internal threads in toe 110 of club head main body 92, or both. Internal threads of bores 104 and 108 fastenably mate with a fastener 112, such as a screw 112. The embodiment provides decorative aesthetics compatible with other embodiments discussed herein.

Referring to FIGS. 5 to 8A, another embodiment of golf head 10 comprises club head main body 32 including support 34 and optional toe dampener 46, and muscle back shell 36. Support 34 and partial sole 38 of club head main body 32 are sized and dimensioned to fit with muscle back shell 36. Toe dampener 46 is made from a viscoelastic material, such as urethane or other polymers, and provides weight redistribution in addition to vibration and sound attention when the golf club strikes a ball.

Club head main body 32 comprises upper back cavity 48, support 34 with first interlocking structure 60, recessed flange 50, partial sole 38 with second interlocking structure 62, and optional toe dampener 46 and cosmetic badge 76. In addition, club head main body 32 may have recess 52 in support 34 providing support 34 with an I-beam profile for weight redistribution to move lower and further back club head center of gravity. Support 34 can be cast integral with hitting face 20, or can be manufactured separately as a different material or same material, such as stainless steel or carbon fiber reinforced plastics, and later attached to hitting face 20 via welding or by interference fit with tension.

Muscle back shell 36 comprises back flange 54 with third interlocking structure 64 and sole section 56 with fourth interlocking structure 66. In addition, muscle back shell 36 may have recess 58 in back flange 54 for weight redistribution to move lower and further back club head center of gravity.

Figure 5:
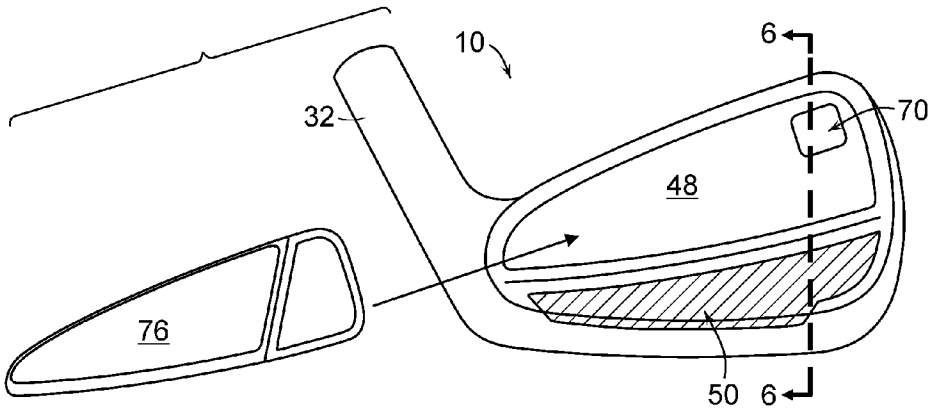
FIG. 5 is an exploded rear view of another inventive club head, optional toe dampener, muscle back shell, and optional cosmetic decal.
Figure 7:
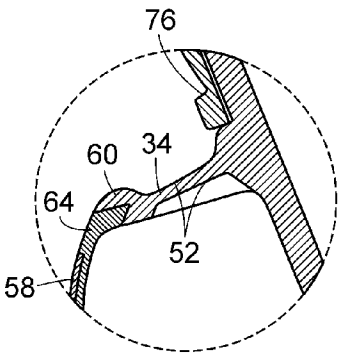
FIG. 7 is an enlarged view of the circled portion of FIG. 6.
Figure 6:
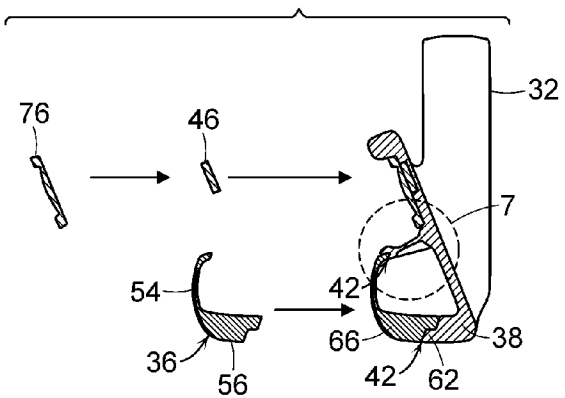
FIG. 6 is an exploded cross-sectional view along line A-A of FIG. 5.

First interlocking structure 60 of support 34 and second interlocking structure 62 of partial sole 38, of club head main body 32, are sized and dimensioned to mate with third interlocking structure 64 of back flange 54 and fourth interlocking structure 66 of sole section 56, of muscle back shell 36, respectively. While any number of interlocking structures can be deployed and the interlocking structures can be arranged in any orientation, it is preferred that a single notch is disposed in support 34 and partial sole 38 and is positioned in the toe-to-heel direction to mate with corresponding interlocking structures 64 and 66, as shown in FIGS. 5 and 7. Alternatively, interlocking structures 60, 62, 64, and 66 can have any profile including, but not limited to, square, triangular, rectangular, curvilinear, sine wave, serrated, etc. Depending on the shape, and in particular the profile in cross section, of the interlocking structures, both increased surface area contact and increased mechanical binding is achieved between club head main body 32 and muscle back 36 when fit together. An advantage of this embodiment is that the shape of interlocking structures 60, 62, 64, and 66 can be matched to other club decorative aesthetics, such as the hosel.

Figure 8:
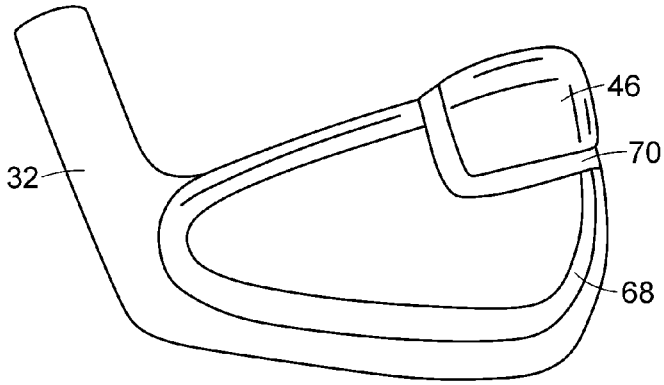
FIG. 8 is a perspective view of the toe dampener using a thinned area.
Figure 8A:
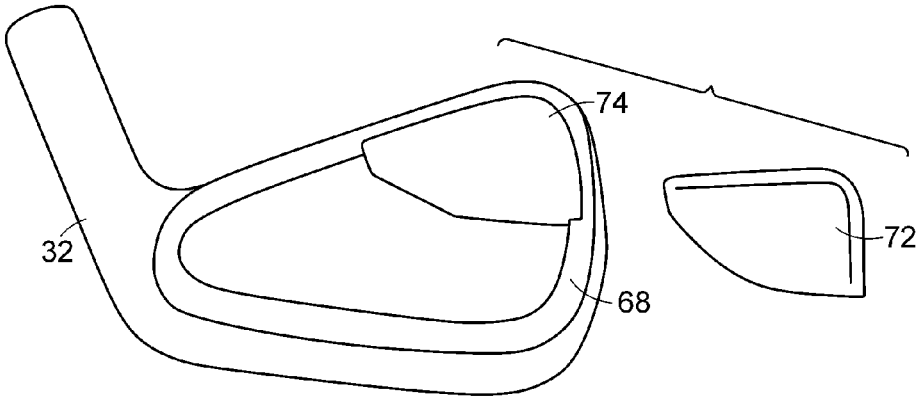
FIG. 8A is a perspective view of the toe dampener using a slot.
Figure 9:
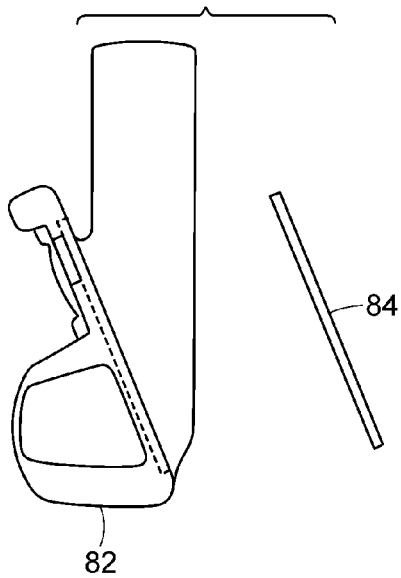
FIG. 9 is an exploded cross-sectional view of another embodiment of the hollow iron-type golf club.

Referring to FIGS. 8-9, by removing mass, in the form of titanium alloy or other suitable material as discussed above, from toe 68 of club head main body 32 and replacing the material, as toe dampener 46, with a lower density material club head center of gravity is moved lower and further back, while also providing vibration and sound attenuation when the golf ball is mis-hit on toe 68 of the golf club. Preferably, toe dampener 46 is made from a soft viscoelastic material such as thermoplastic elastomer, rubber, or polyurethane that has a density in the range of about 0.8 g/cm$^3$ to about 1.5 g/cm$^3$ and Shore A40-A90 hardness rating. Preferably, toe dampener 46 is created by thinning an area 70 in toe 68 on the back of club head main body 32, as shown in FIG. 8. Alternatively, thinned area 70 is in upper back cavity 48. In either case, thinned area 70 is replaced with viscoelastic toe dampener 46. An alternative embodiment comprises a lightweight member 72 made of viscoelastic material that is inserted into a slot 74 created in toe 68 of club head main body 32, as shown in FIG. 8A. Slot 74 can also be formed in the middle of the topline of the club head. Alternatively, a combination of thinned areas and slots may be used to add viscoelastic material to club head main body 12.

Toe dampener 46 viscoelastic material provides vibration attenuation that reduces the distance and off-line penalties, and unpleasant sensation radiating up the shaft into the hands and arms of the golfer when a ball is mis-hit on toe 68 of club head main body 32. Furthermore, golf balls mis-hit on high toe 68 cause a low frequency ("bass"), high amplitude ("loud") noise. The viscoelastic material in toe dampener 46 provides sound attenuation that generates an esthetically pleasing sound when a golf club strikes a ball. Additionally, the number of high toe mis-hits is statistically low therefore less metal is required at that location and the metal can be replaced with lower density polymers.

Finally, optional cosmetic badge 76 adheres to the upper back cavity 48 of the club head main body 32. If toe dampener 46 is produced by thinning an area 70 as shown in FIG. 8, then cosmetic badge 76 holds toe dampener 46 captive against back of club head main body 32. In addition to the current embodiment, toe dampener 46 and cosmetic badge 76 are applicable to all the embodiments discussed herein.

To assemble club head 10, muscle back shell 36 is attached to support 34 and partial sole 38 of club head main body 32. Preferably, attachments 42 of muscle back 36 to club head main body 32 are made permanent by welding, fasteners or force fitting with or without adhesive, as discussed above.

Referring to FIG. 9, another embodiment of club head 10 comprises separate face plate 84 that is welded to club head main body 82 rather than being made integral. An advantage of this embodiment is that the style and/or density of face plate 84 can be changed without modifying the rest of club head 10.

Figure 10:
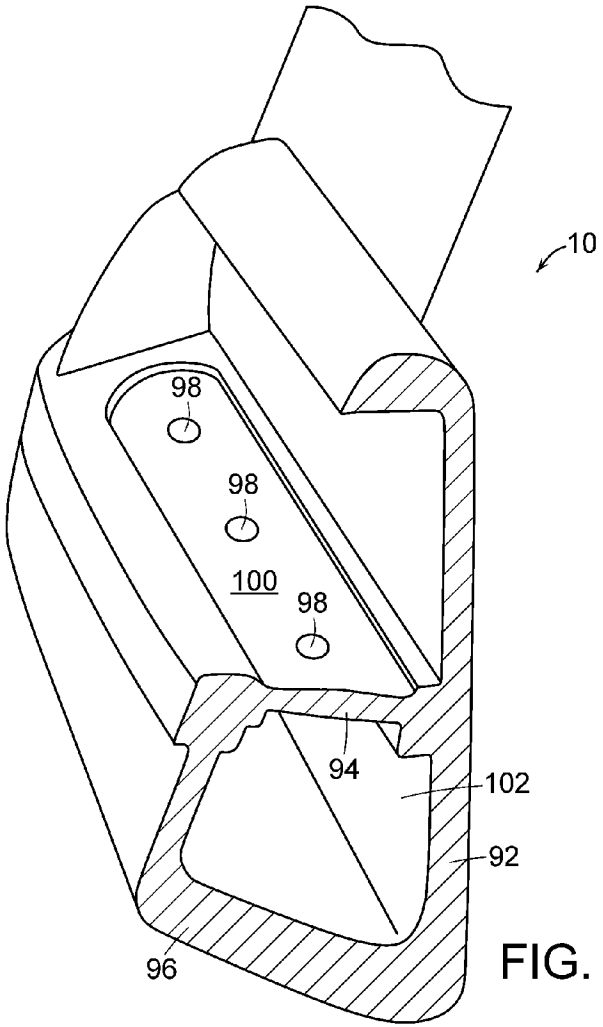
FIG. 10 is an enlarged cross-sectional view of another embodiment of the hollow iron-type golf club.

Referring to FIG. 10, another embodiment of golf head 10 comprises holes or openings 98 on top surface 100 of support 94 of club head main body 92. Internal cavity 102 formed by club head main body 92 and muscle back shell 96 can be filled with material including, but not limited to, foamed or unfoamed polyurethane, or other substance, to prevent water, or other material, from entering otherwise hollow cavity 102. The material can be transparent or translucent, clear or colored, and may have multiple colors exposed through openings 98. Hollow cavity 102 can be filled through openings 98. While any number of holes can be deployed and the holes can be arranged in any orientation, it is preferred that three holes 98 are used and are positioned in the toe-to-heel direction. Alternatively, holes can have any arrangement including, but not limited to, diamond, oval, etc. An advantage of using filling material is to increase the dampening effect and to provide additional aesthetics to the club head, allowing the user to look into the muscle back. Hollow cavity 102 may not be filled completely. Instead, a material can be added into hollow cavity 102 to bring the club head to any desired weight during manufacturing. For example, up to 6 grams of mass can be added to bring the weight of the club head to regulation weight. Suitable added mass includes, but is not limited to an adhesive commonly known in the art as rat glue.

Top surface 100 can be a recessed surface, as illustrated in FIG. 10. The recess can be filled with a three-dimensional insert, which can be a filler or can serve as a badge carrying marketing indicia or a bridge. The insert can have any shape and can have an L-shape. The insert can also be functional, e.g., to dampen vibration from impacts with golf balls. Suitable dampening materials include, but are not limited to, soft polymers having hardness value from Shore A30 to ShoreA-90, preferably from Shore A-35 to Shore A-60. The functional insert can carry sensors and or electronics to measure location of impacts on the hitting face. In one embodiment, the sensors are located on or proximate to the hitting face and the electronics including memory, such as EEPROM and other memory storage devices, is located proximate to the grip of the club to minimize vibration to the sensitive electronics.

Figure 11:
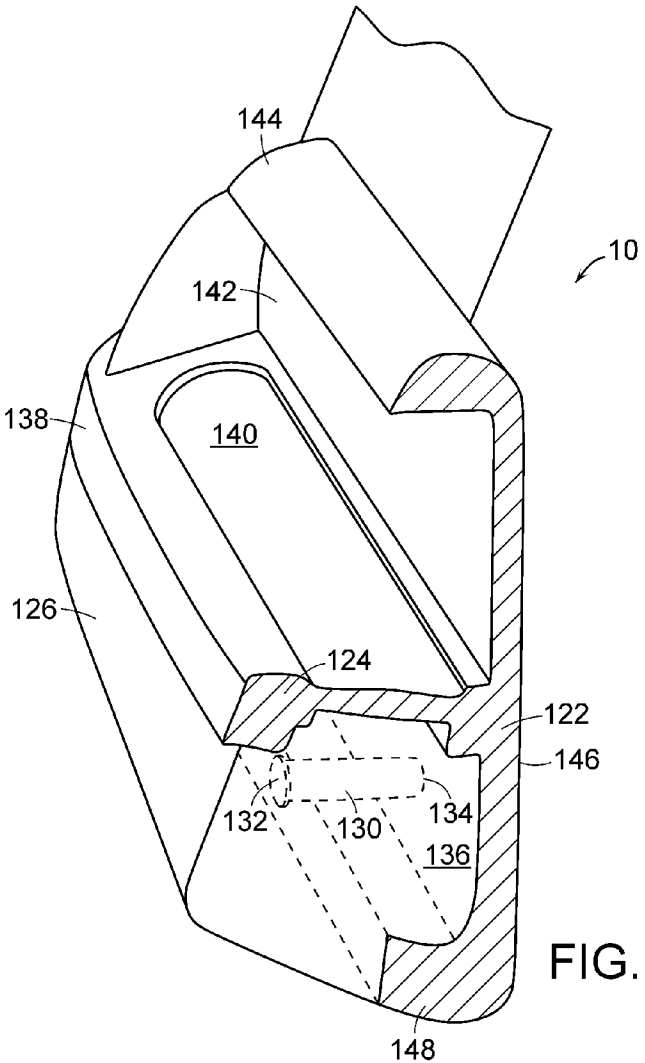
FIG. 11 is an enlarged cross-sectional view of another embodiment of the hollow iron-type golf club.
Figure 11A:
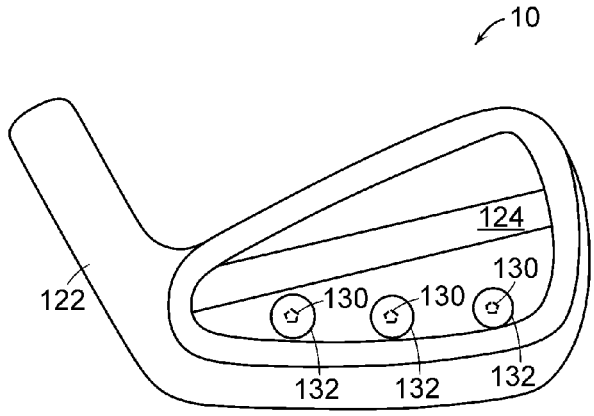
FIG. 11A is a perspective rear view of the club head main body.

Referring to FIGS. 11-11A, another embodiment of club head 10 comprises posts 130 projecting from back 136 of club head main body 122. Posts 130 comprise enlargedheads 132 that provide mounting attachments, or anchors, for muscle back solid 126 disposed on top of posts 130 and support 124 projecting from back 136 of main body 122. Suitable materials for posts 130 include, but are not limited to, lead, tungsten, gold, or silver. Preferably, posts 130 are made from tungsten nickel alloy. Posts 130 are custom milled, as needed, for weight distribution, to move the center of gravity lower and further back. Preferably, enlargedheads 132 have a disk shape as shown in FIGS. 11-13A, or any other suitable shape, such as cube, octahedron, sickle, boat anchor, etc. Whereas suitable material for making translucent overcast of muscle back solid 126 may include, but is not limited to, polyurethane, or similar substance, made into any color, design, logo, etc.

Figure 12:
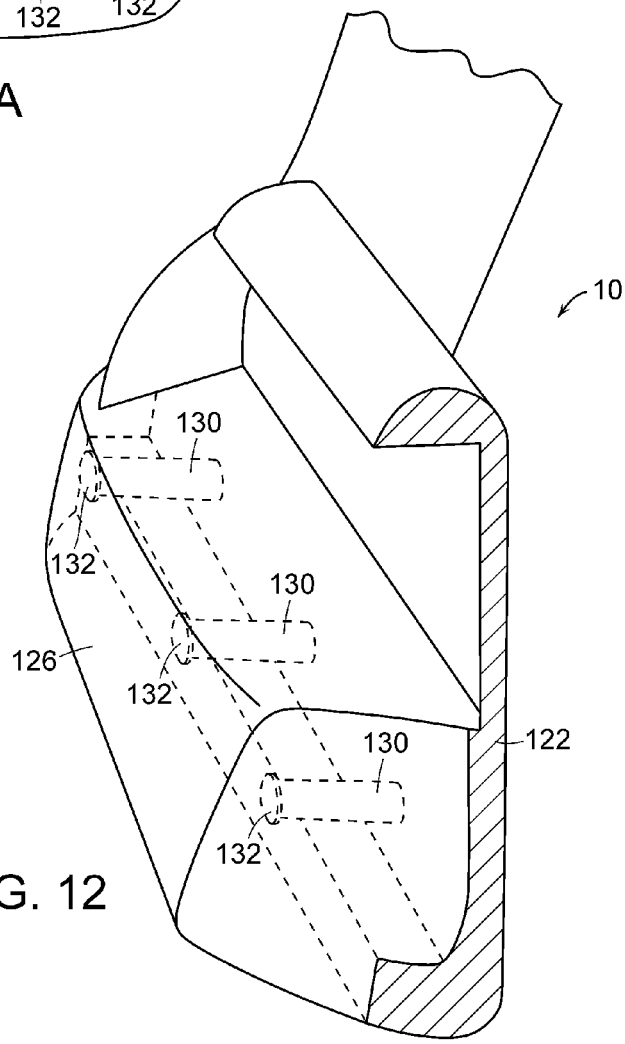
FIG. 12 is an enlarged cross-sectional view of another embodiment of the hollow iron-type golf club.

To assemble club head 10, posts 130 are attached to back 136 of club head main body 122 at attachment lines 134. Preferably, attachments 134 of posts 130 to club head main body 122 are made permanent by welding, fasteners or adhesive. Then, the mold for making muscle back solid 126 is created with club head main body 122 forming a part of the mold. Main body 122 connects with a half-mold that would create muscle back 126. While any number of posts can be deployed and the posts can be arranged in any orientation, it is preferred that three posts 130 are used and are positioned in the toe-to-heel direction to move the center of gravity low to the ground. Alternatively, posts can have any arrangement including, but not limited to, square, triangular, rectangular, curvilinear, diamond, oval, etc. An alternative embodiment comprises no support as shown in FIG. 12.

Figure 13A:
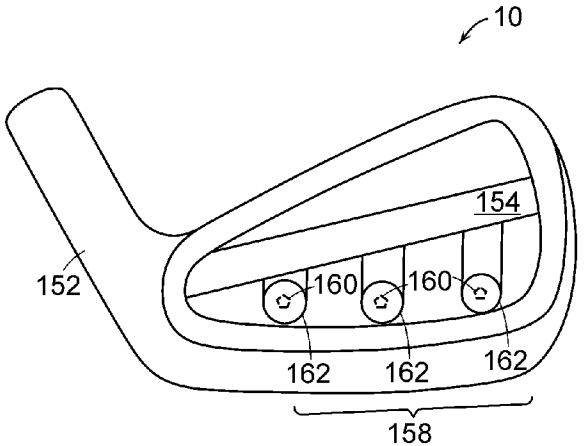
FIG. 13A is a perspective rear view of the club head main body.
Figure 13:
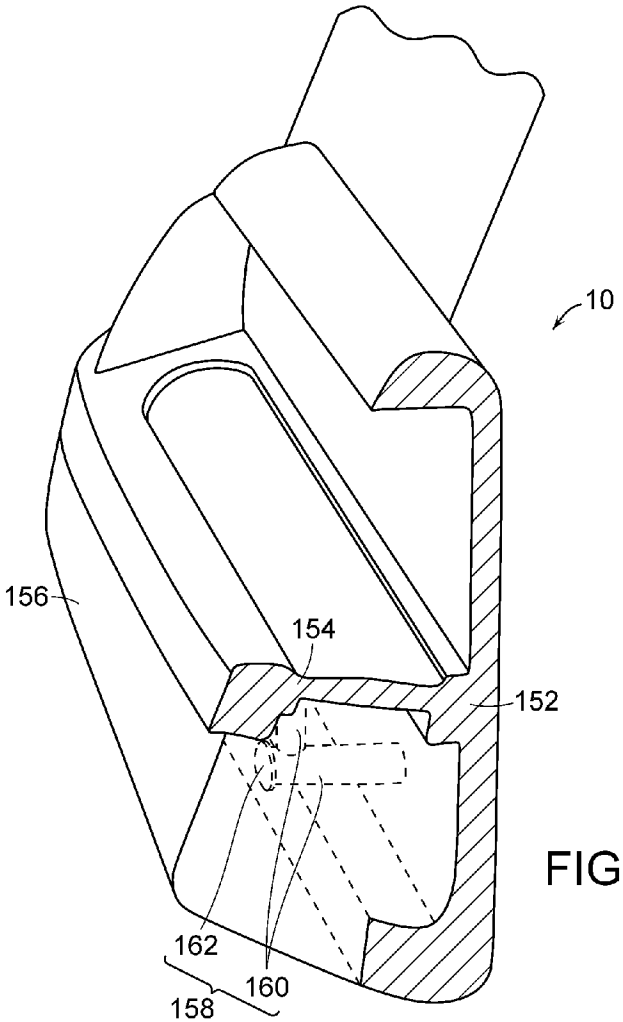
FIG. 13 is a cross-sectional exploded view of another embodiment of the hollow iron-type golf club.

Referring to FIGS. 13-13A, another alternative embodiment comprises a honeycomb system 158 of many interconnected anchors 160 and enlarged heads 162 attached to support 154 and back of club head main body 152. Muscle back solid 156 is a translucent overcast disposed on top of honeycomb system 158. In manufacturing club head 10, honeycomb system 158 of club head main body 152 is part of the mold, as discussed above.

All the main bodies of the golf head 10 embodiments, discussed above, may be constructed from a cast or forged stainless steel 431.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim

1. A golf club head comprising a club head main body and a muscle back shell, wherein the club head main body comprises a first material and a partial sole, and the muscle back shell comprises a second material different from the first material, wherein the club head main body and the muscle back shell cooperate to improve the mass properties of the club head, wherein the club head main body comprises an elongate supporting member protruding rearward from a hitting face and across a portion of the hitting face in a generally heel to toe direction and supporting the hitting face to maintain the mechanical integrity of hitting face, wherein the supporting member protrudes rearward from the hitting face by a greater distance than the partial sole extends rearward from the hitting face, and wherein the muscle back shell, the hitting face and the supporting member define a hollow interior cavity in a muscle portion of the club head, the golf club head further comprising a third material having a lower density than the first material, wherein the third material is disposed between the muscle back shell and the main body.

2. The golf club head of claim 1, wherein the first material has a lower density than the second material.

3. The golf club head of claim 2, wherein the first material has a density between about 4 g/cm$^3$ and about 8 g/cm$^3$ and the second material has a density between about 9 g/cm$^3$ and about 19 g/cm$^3$.

4. The golf club head of claim 1, wherein the third material is a translucent, polymeric material, and the club head comprises at least one opening so that the translucent material can be viewed externally.

5. The golf club head of claim 1, wherein the club head main body comprises an upper toe dampener.

6. The golf club head of claim 5, wherein the toe dampener has lower density than the club head main body.

7. The golf club head of claim 5, wherein the toe dampener comprises a viscoelastic material.

8. The golf club head of claim 7, wherein the viscoelastic material is thermoplastic elastomer with density in the range of about 0.8 g/cm$^3$ to about 1.5 g/cm$^3$ and about Shore A40 to Shore A90 hardness rating.

9. The golf club head of claim 5, wherein the toe dampener is held captive by a cosmetic badge.

10. The golf club head of claim 9, wherein the toe dampener is inserted into a slot of the club head main body.

11. The golf club head of claim 1, wherein the back of the club head main body comprises a cosmetic badge.

12. The golf club head of claim 1, wherein the club head main body and the hitting face are made integral to each other.

13. The golf club head of claim 1, wherein the club head main body comprises a separate hitting face.

14. The golf club head of claim 1, wherein the supporting member is formed integral to the hitting face.

15. The golf club head of claim 14, wherein the muscle back shell is attached to the supporting member.

* * * * *